US006234101B1

(12) United States Patent
Czipri

(10) Patent No.: US 6,234,101 B1
(45) Date of Patent: May 22, 2001

(54) CHOCK

(75) Inventor: John Czipri, Palm Harbor, FL (US)

(73) Assignee: Accon Marine, Inc., Clearwater, FL (US)

( * ) Notice: Subject to any disclaimer, the term of this patent is extended or adjusted under 35 U.S.C. 154(b) by 0 days.

(21) Appl. No.: 09/467,394

(22) Filed: Dec. 20, 1999

(51) Int. Cl.[7] ..... B63B 21/04
(52) U.S. Cl. ..... 114/218
(58) Field of Search ..... 114/218, 219, 114/221 R, 230.1, 230.16; 24/115 K, 115 G, 115 R, 136 R, 265 CD; 410/55, 96, 101, 102, 107, 111, 116, 343, 199

(56) References Cited

U.S. PATENT DOCUMENTS

| | | | | |
|---|---|---|---|---|
| 1,868,580 | * | 7/1932 | McKinney | 70/208 |
| 2,729,417 | * | 1/1956 | Maynard | 410/111 |
| 2,833,240 | * | 5/1958 | Semolic | 114/218 |
| 3,111,833 | * | 11/1963 | Dettmer | 70/140 |
| 3,215,390 | * | 11/1965 | Shetler | 410/116 |
| 3,234,765 | * | 2/1966 | Kerr | 70/208 |
| 3,917,213 | * | 11/1975 | Poehlmann | 248/509 |
| 4,352,336 | * | 10/1982 | Tostado | 114/218 |
| 4,672,909 | * | 6/1987 | Sweetsir | 114/218 |
| 4,809,634 | | 3/1989 | Czipri . | |
| 4,820,094 | * | 4/1989 | Hirakui et al. | 410/107 |
| 4,890,566 | * | 1/1990 | Morris | 114/218 |
| 4,966,018 | * | 10/1990 | Hauber | 70/208 |
| 5,004,388 | * | 4/1991 | Harris | 410/107 |
| 5,106,248 | * | 4/1992 | Harris | 410/107 |
| 5,301,627 | | 4/1994 | Czipri . | |
| 5,535,694 | | 7/1996 | Czipri . | |
| 5,983,820 | * | 11/1999 | Whitley | 114/218 |
| 6,125,779 | * | 10/2000 | Czipri | 114/218 |

* cited by examiner

*Primary Examiner*—S. Joseph Morano
*Assistant Examiner*—Ajay Vasudeva
(74) *Attorney, Agent, or Firm*—Harold D. Shall

(57) ABSTRACT

A chock wherein a movable inner member is received for relative vertical movement in a housing with the inner member having a conventional diagonal slot therein for receiving a line. The housing has a central counter bore at the top thereof, and a smaller bore extending therefrom and said inner member is received in the housing for relative axial movement between a depressed inoperative position and an upper operative position. A set screw carried by the housing engages a slot in the inner member for limiting relative axial movement therebetween, while a spring loaded poppet carried by the housing is engageable with a detent near the bottom of the inner member to resiliently hold the inner member vertically stationary relative to the housing when in its upper position.

2 Claims, 2 Drawing Sheets

CHOCK

BACKGROUND OF THE INVENTION

1. FIELD OF THE INVENTION

This invention relates generally to chocks and more particularly to chocks having a depressed or concealed position and a raised operative position.

2. DESCRIPTION OF THE PRIOR ART

No prior art was found relating to chocks having a depressed position and a raised operative position. Some prior art cleats have such positions; however their structures such as shown in my U.S. Pat. No. 4,809,634; 5,535,694 and 5,301,627 are entirely different than the structure of the present invention which is very compact durable and easily serviced.

SUMMARY OF THE INVENTION

A chock, having a conventional appearing slot in the upper end thereof for receiving a line, has a lower portion projecting downwardly therefrom and telescopically received in an opening of a base or housing portion; the later being adapted to be mounted on a boat hull in a non obtrusive manner. A poppet, carried by the base portion, can alternately engage or disengage a detent in the lower portion to thereby hold the chock in its upper position and, when in its lower position, the poppet acts as an anti rattle device. An abutting member is threaded into and carried by the base portion and engages an elongated grove in the lower portion to both limit vertical and rotational movement of the lower portion relative to the base. This abutting member is threaded into the base portion and can be screwed outwardly out of engagement with the groove to allow the upper portion of the chock to be removed from the base and can be screwed inwardly to fit in the elongated groove to perform at its function. As wear takes place, the abutting member can be adjusted.

DESCRIPTION OF THE PREFERRED EMBODIMENT

Figure 1:
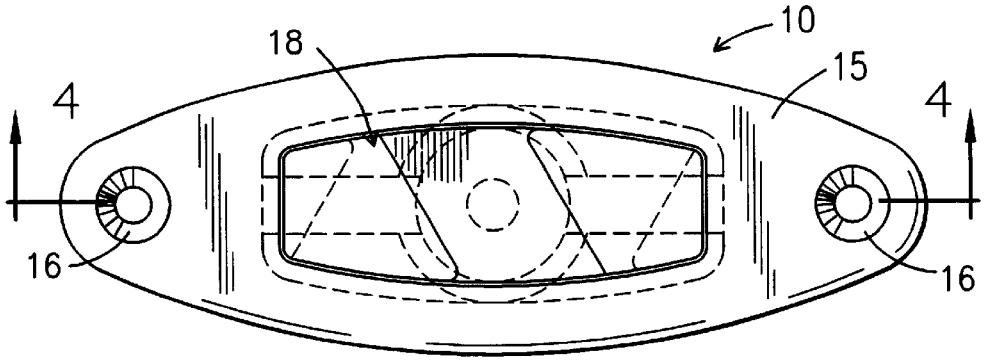
FIG. 1 is a plan view of a chock made according to this invention.
Figure 2:
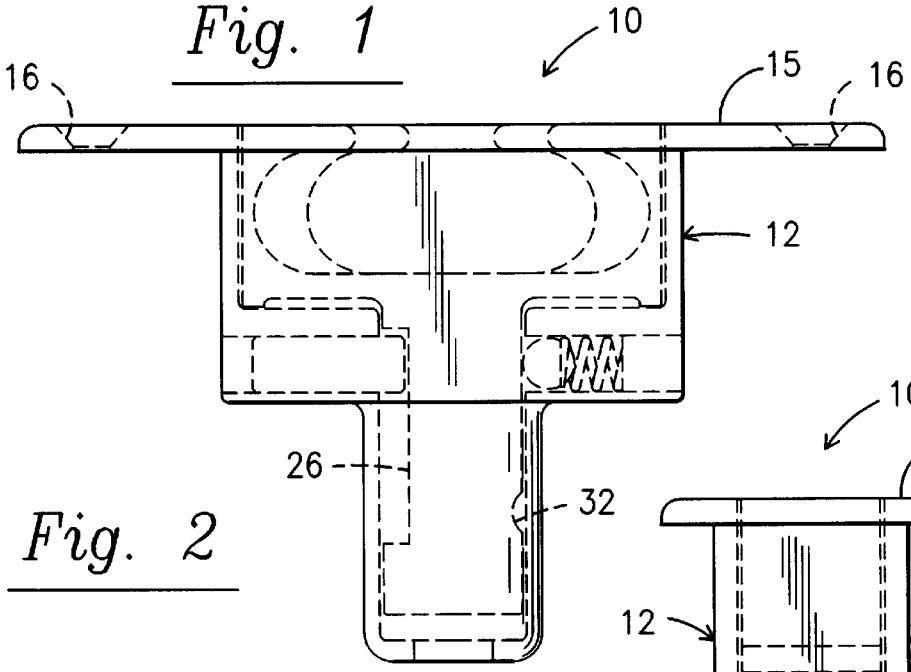
FIG. 2 is a side elevational view of the chock of FIG. 1.
Figure 3:
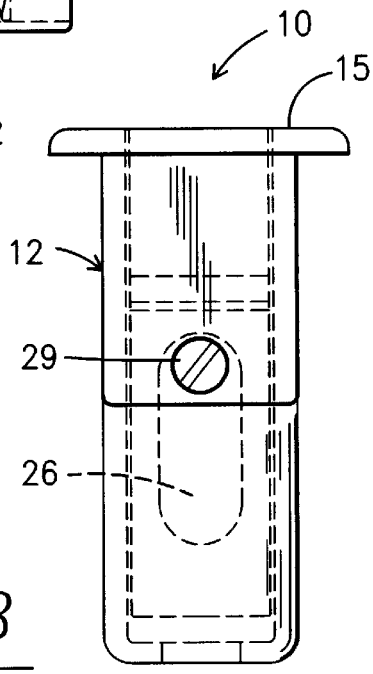
FIG. 3 is an end elevational view of the chock of FIGS. 1 and 2 of this invention.

A chock assembly shown generally at 10 includes a base portion 12 having a central vertically extending cylindrical bore 13 , a larger elongated counterbore 14 coaxial therewith and an elongated flange portion 15 surrounding the topmost end of the counterbore; the latter being adapted to be mounted flush on the top of a vessel's deck or other portion of the hull by fasteners extending through a pair of openings 16 in the opposed ends of the flange 15. A telescope member 18 has an enlarged upper end 19 with a conventional chock slot 20 therein; the periphery of the upper end 19 being adapted to be closely received in the counterbore 14, and a cylindrical lower end 21 fittingly received in the cylindrical bore 13 for relative vertical movement. The cylindrical bore

14 terminates at its lower end in an elongated shoulder 22, with the bore 13 commencing with the shoulder.

Figure 4:
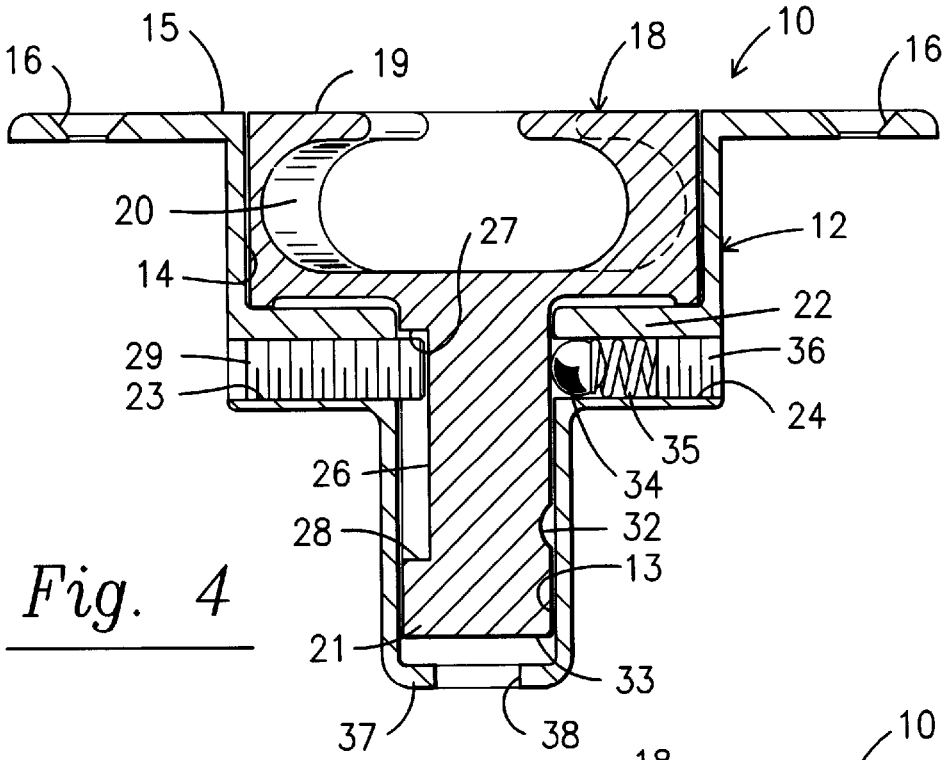
FIG. 4 is a cross sectional view taken along the lines 4—4 in FIG. 1, with the chock in its depressed or concealed position.
Figure 5:
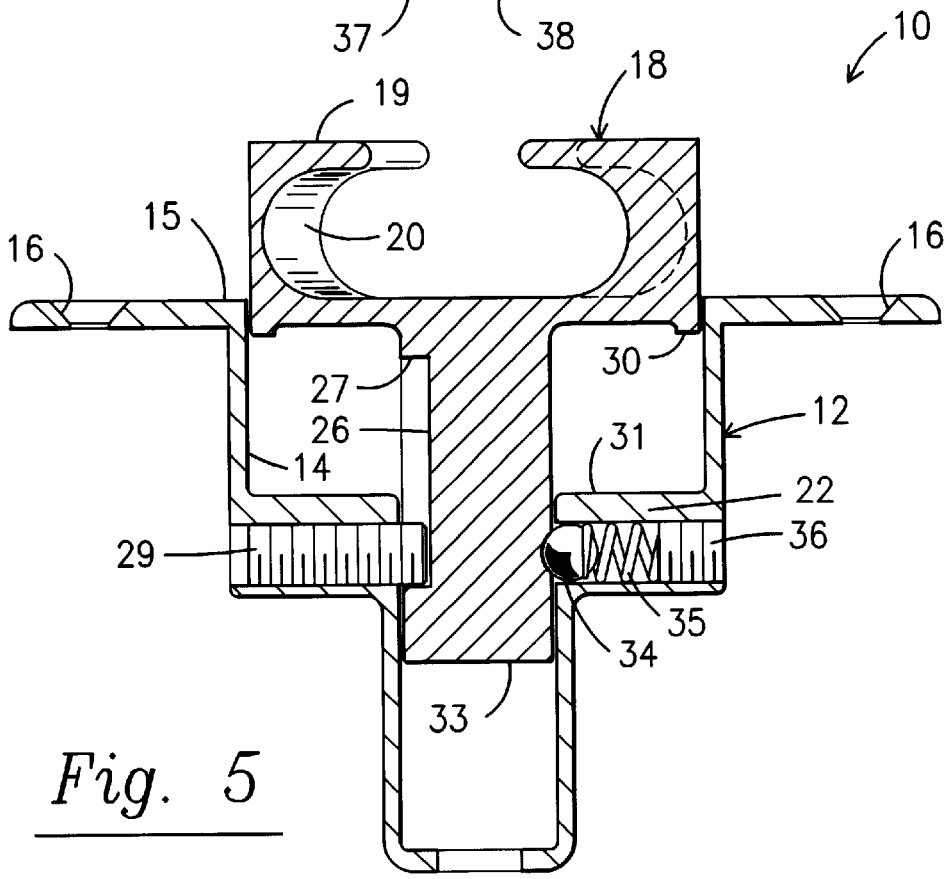
FIG. 5 is a view taken like FIG. 4 with the chock in its raised operative position.

A pair of horizontally opposed threaded openings 23 and 24 are formed in the shoulder 22, and project from the outer surface of the shoulder to terminate at the bore 13. A vertically elongated slot 26 is formed in one axial side of the lower end 21 so as to be aligned with the threaded opening 23, with the slot ending in an upper shoulder 27 and a lower shoulder 28. An abutting member in the form of a set screw 29 is threaded into the threaded opening 23 with the inner end received in the slot 26 for relative vertical movement; the set screw abutting the upper shoulder 27 to assist limiting downward movement of the member 18 (as shown in FIG.4) or, as shown in FIG. 5, abutting the lower shoulder 28 to limit upward movement of the member 18. The shoulder 30 between the upper end 19 and the lower end 21 of the member 18 being abuttable with the upper surface of the shoulder 22 to also limit downward movement of the member 18.

The lower end 21 of the member 18 has a detent 32 formed therein on the side thereof opposed to the slot 26 and positioned near the bottom end 33 of the member 18. A poppet 34 is received in the threaded opening 24 at the inner end thereof and is engageable in the detent 32. A spring means in the form of a coiled compression spring 35 is received in the opening 24 and compressed between the poppet 34 and a second set screw 36, whereby the poppet 34 resiliently engages in the detent 32 to resiliently inhibit downward movement of the member 18 when in its upper operative position. Pressing on the top of the member 28 over comes the poppet 34 and the member 18 moves to its downward concealed position as seen in FIG. 4. At this time, the bottom 33 of the member 18 is spaced from the bottom 37 of the base portion 12. A drain hole 38 is provided in the bottom 37 to drain any water which may inadvertently enter the base portion 12. The hole 38 may drain directly into the bilge or be connected thereto by a conduit fitted into the hole 38. When the member 18 is in its lower position, the poppet 34 resiliently engages the surface of the lower end 21 and acts as an anti-rattle device. While only a single embodiment of this invention has been shown and described, it is understood that many changes therein can be made without departing from the scope of this invention as defined by the following claims.

What is claimed is:

1. A chock having a raised operative position and a depressed inoperative position, comprising A) a housing including an attaching flange and a base portion extending downwardly therefrom, B) a vertically movable member having an enlarged upper end and a lower end with said lower end formed integrally with said upper end and extending downwardly therefrom, and said lower end being smaller in cross sectional area than said upper end, C) said housing having an upper counterbore and a lower bore extending downwardly therefrom and having a shoulder between said upper counterbore and said lower bore, D) said movable member having a raised operative position and a depressed inoperative position and, when in its depressed position, having the enlarged upper end fittingly received in said counterbore of said housing and having the lower end fittingly received in said lower bore, E)a detent formed in said lower end of said movable member with said lower end having a side thereof adjacent said detent, F) a spring loaded poppet disposed in said shoulder and engageable with said detent when said movable member is in its upper position, and said poppet resiliently engaging said side of said lower end of said movable member that is in vertical alignment with said poppet when said movable member is in its lower position, G) a vertically elongated slot in said lower end of said movable member, and H ) a first adjustable set screw disposed in said shoulder and engageable in said slot to limit upward movement of said movable member relative to said housing, said housing has a second laterally extending threaded opening therein removably receiving said first adjustable set screw, with said first adjustable set screw being removable from the exterior of said housing so that said chock can be disassembled, and wherein said set screws are coaxially aligned.

2. A chock having a raised operative position and a depressed inoperative position, comprising A) a housing including an attaching flange and a base portion extending downwardly therefrom, B) a vertically movable member having an enlarged upper end and a lower end with said lower end formed integrally with said upper end and extending downwardly therefrom, and said lower end being smaller in cross sectional area than said upper end, C) said housing having an upper counterbore and a lower bore extending downwardly therefrom and having a shoulder between said upper counterbore and said lower bore, D) said movable member having a raised operative position and a depressed inoperative position and, when in its depressed position, having the enlarged upper end fittingly received in said counterbore of said housing and having the lower end fittingly received in said lower bore, E) a detent formed in said lower end of said movable member, F) a spring loaded poppet disposed in said shoulder and engageable with said detent when said movable member is in its upper position, and said poppet resiliently engaging the side of said lower end of said movable member that is in vertical alignment with said poppet when said movable member is in its lower position G) a vertically elongated slot in said lower end of said movable member, and H ) a first adjustable set screw disposed in said shoulder and engageable in said slot to limit upward movement of said movable member relative to said housing, said housing has a lateral first threaded opening therein receiving said poppet, a second set screw received in said threaded opening and a compression spring engageably positioned between said second set screw and said poppet for urging said poppet inwardly and said housing has a second laterally extending threaded opening therein removably receiving said first adjustable set screw, with said First adjustable set screw being removable from the exterior of said housing so that said chock can be removed, and wherein said set screws are coaxially aligned.

* * * * *